United States Patent [19]

Caveney et al.

[11] 4,191,442

[45] Mar. 4, 1980

[54] ELECTRICAL CONNECTOR AND METHOD OF FABRICATING A WIRE HARNESS USING THE CONNECTOR

[75] Inventors: Jack E. Caveney, Hinsdale; Roy A. Moody, Flossmoor, both of Ill.

[73] Assignee: Panduit Corp., Tinley Park, Ill.

[21] Appl. No.: 909,732

[22] Filed: May 25, 1978

[51] Int. Cl.[2] ..... H01R 13/38

[52] U.S. Cl. ..... 339/99 R; 339/223 R

[58] Field of Search ..... 339/97 R, 97 C, 97 P, 339/98, 99 R, 223

[56] References Cited

U.S. PATENT DOCUMENTS

| | | | |
|---|---|---|---|
| 3,145,261 | 8/1964 | Forney, Jr. | 339/98 |
| 3,410,950 | 11/1968 | Freudenberg | 339/97 C |
| 3,778,750 | 12/1973 | Caveney et al. | 339/97 R |
| 4,127,312 | 11/1978 | Fleischhacker et al. | 339/99 R |

FOREIGN PATENT DOCUMENTS

| | | | |
|---|---|---|---|
| 2653593 | 6/1977 | Fed. Rep. of Germany | 339/99 R |

*Primary Examiner*—Joseph H. McGlynn

*Attorney, Agent, or Firm*—Charles R. Wentzel; Richard B. Wakely

[57] ABSTRACT

An electrical connector for mechanically joining a plurality of wires to a plurality of other electrical components and for providing low resistance electrical paths between predetermined ones of the plurality of wires and preselected ones of the plurality of other electrical components. The connector includes an insulative housing having a front wall, a back wall and a plurality of spaced barrier walls extending between the front wall and back wall to define an array of cavities extending through the housing. The connector also includes a plurality of metallic terminal elements each of which has a wire terminating portion and a portion for receiving another electrical component with one terminal element preloaded into each of the housing cavities prior to wiring of the connector. The wire terminating portion has an open-ended elongate wire-receiving slot having a width less than the diameter of the conductor in the wire to be terminated in the wire terminating portion so that in response to the insertion of the wire laterally of its axis into the slot, the insulation of the wire is removed. The wire terminating portion further includes an entrance adjoining the slot and of greater width than the slot to guide the wire into the slot. The housing and/or the terminal element has holding means for mechanically holding each wire in alignment with the entrance to the slot corresponding to that wire prior to insertion of the wire into the slot whereby after positioning of the wires into the holding means and prior to insertion of the wires into the slots, the connector can be physically moved without dissociation of the wires from their corresponding slots.

24 Claims, 25 Drawing Figures

ELECTRICAL CONNECTOR AND METHOD OF FABRICATING A WIRE HARNESS USING THE CONNECTOR

BACKGROUND OF THE INVENTION

The present invention relates to an improved electrical connector and a method of wire harness fabrication using the connector and more particularly to a connector of the type used for terminating a plurality of wires and connecting them to a like plurality of other electrical components.

The long accepted method of fabricating a wire harness including a plurality of spaced multi-contact connectors with individual terminal elements of the connectors interconnected by runs of insulated wires commences with positioning wire fanning strips on a panelboard adjacent to the desired placement of the various connectors in the fabricated harness. The wires are then typically individually run on the panelboard between slots in the fanning strips corresponding to their desired termination points along common routes corresponding to branches in the finished harness. After all the wires have been run as desired, the wires in the common routes are formed into bundles by means of cable ties or the like such as shown in commonly assigned U.S. Pat. No. 3,872,547. Next the insulation is stripped from the wire ends, pin terminals are affixed to the wire ends and the pin terminals are inserted in the sockets of the multi-contact connectors. It will be appreciated that this method is expensive and time-consuming due to the number of iterative steps, and due to the tedious nature of the method, the assembler is prone to make wiring errors requiring expensive rewiring or, in an extreme case, scrapping of the harness.

An alternate method of fabrication has been proposed wherein the multi-contact connectors used have terminal elements adapted to remove the wire insulation upon insertion of the wire into the element obviating the need for manually preparing the wires. This method requires the use of wire spacing and holding jigs affixed to the panelboard and termination apparatus mounted on the jig for inserting the wires into the connector. Reference may be made to U.S. Pat. No. 3,859,724.

SUMMARY OF THE INVENTION

Among the several objects and features of the present invention may be noted the provision of an improved multi-contact electrical connector for use in a wire harness; the provision of such a connector which firmly mechanically holds wires in desired positions prior to their electrical termination in the connector so that harnesses completed except for electrical termination can be fabricated at a plurality of fabrication stations and electrically terminated at a single termination station having a single set of termination apparatus; the provision of such a connector which avoids the need for separate fanning strips or wire holding jigs mounted on layout boards in the fabrication of the wire harness; the provision of such connector which provides strain relief to hold wires after termination; and the provision of such connector which is reliable in use, has long service life, and is simple and economical to manufacture. Other objects and features of the present invention will be in part apparent and in part pointed out hereinafter in the specification and in the claims annexed thereto.

Briefly, the connector of the present invention includes an insulative housing having a front wall, a back wall, and a plurality of spaced barrier walls joining the aforementioned walls to define an array of cavities extending through the housing. The cavities each receive a metallic terminal element having a wire terminating portion and a portion for contacting another electrical component. The wire terminating portion has an open ended elongate wire receiving slot of a width less than the diameter of the conductor in the wire to be terminated in that wire receiving portion so that in response to the insertion of the wire laterally of its axis into the slot, the insulation of the wire is removed. The wire receiving portion also includes an entrance adjoining the slot and of greater width than the slot to guide the wire into the slot. The housing and/or the terminal element includes holding means for firmly mechanically holding each of the wires in alignment with the entrance of the slot corresponding to that wire prior to insertion of the wire into the slot.

BRIEF DESCRIPTION OF THE DRAWINGS

Corresponding reference characters indicate corresponding components throughout the several views of the drawings.

DESCRIPTION OF THE PREFERRED EMBODIMENTS

Figures 1, 2:
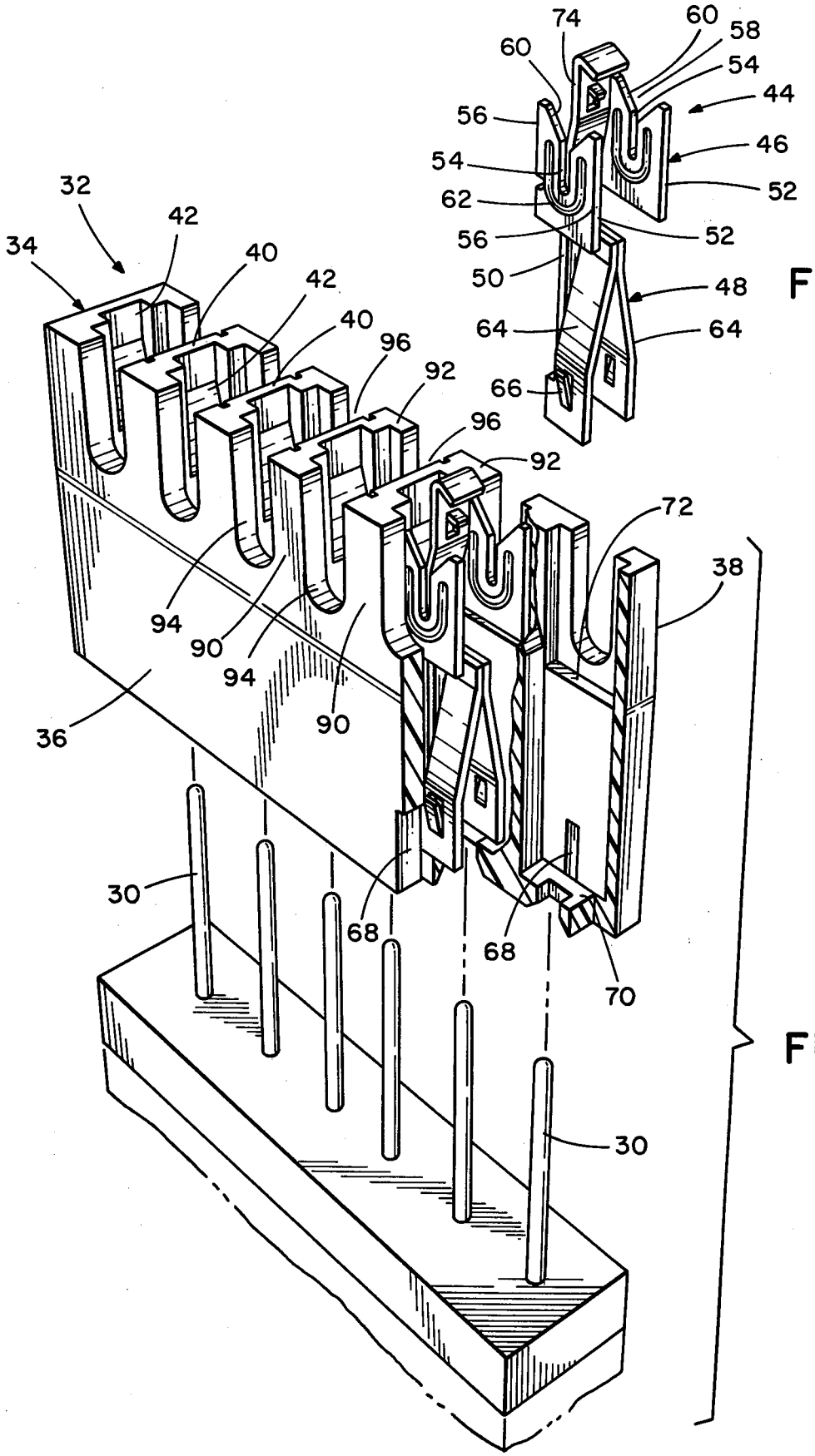
FIG. 1 is a perspective view of a contact element used in the connector of the present invention including a wire receiving portion having spaced slotted parallel plates for receiving an insulated wire to be terminated and further having a wire retaining arm.
FIG. 2 is a perspective view of the connector of the present invention including an insulative housing including spaced cavities for receiving the contact elements of FIG. 1 with certain components of the housing removed.

Referring now to FIGS. 1–4, an electrical connector for mechanically joining a plurality of wires 28 to a plurality of other electrical components such as terminal pins 30 and for providing a low resistance electrical path between predetermined ones of the plurality of wires and preselected ones of the plurality of pins is generally indicated by reference numeral 32. The connector includes an insulative housing 34 having a front wall 36, a back wall 38 and a plurality of spaced barrier walls 40 extending between the front and back walls to define an array of cavities 42 extending through the housing. Received within each cavity 42 is a terminal element 44, best shown in FIG. 1, preferably formed from a sheet metal blank and including a wire-receiving portion 46 and a portion for contacting another electrical component such as a pin-receiving portion 48 joined by a stem 50. Terminal elements 44 are preloaded into cavities 42 prior to wiring to the connector and each element includes latch means for locking the terminal elements in the housing.

More specifically, the wire-receiving portion 46 of terminal element 44 includes a pair of spaced generally parallel plates 52 extending in a direction generally perpendicular to the barrier walls with each plate having an open-ended wire-receiving slot 54 defined by a pair of plate sections 56 and having a width less than the metallic conductor of the insulated wire to be inserted into the wire-receiving portion so that in response to movement of the wire laterally to its axis, the wire insulation is removed effecting electrical termination of the wire in the wire-receiving portion. Adjoining each wire-receiving slot is an entrance 58, of greater width than the slot, for guiding the wire into the slot. The entrance is defined by support surfaces 60 which in another embodiment of the present invention function, as will be described more fully hereinafter, to mechanically support the wire prior to its insertion into the slot 54. Each plate 52 also preferably has a U-shaped strengthening rib 62 partially circumscribing slot 54.

Terminal element pin receiving portion 48 comprises a pair of deflectable spring arms 64 for receiving and holding one of the terminal pins 30. One or both of the spring arms is provided with latch means in the form of an outwardly bent tang 66 which upon completion of insertion of the terminal element into the housing 34 extends through a window 68 in the housing thereby locking the terminal element in the housing. The housing also includes a pair of ledges 70 and 72 for supporting the spring arm 64 and plate 52, respectively, when the terminal element is locked in the housing.

Figure 3:
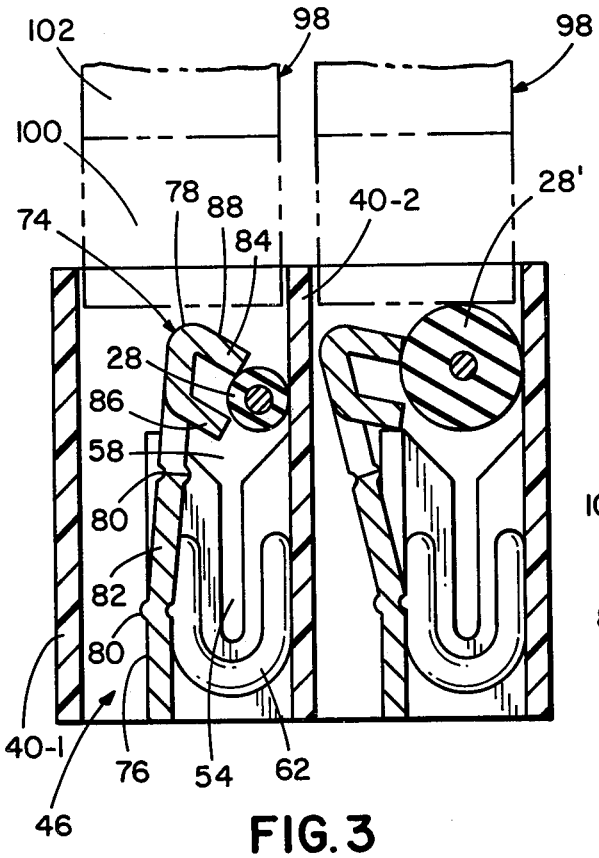
FIG. 3 is a partial sectional view through the connector of FIG. 2 showing wires in adjacent cavities being mechanically held by respective wire retaining arms prior to their electrical termination.
Figure 4:
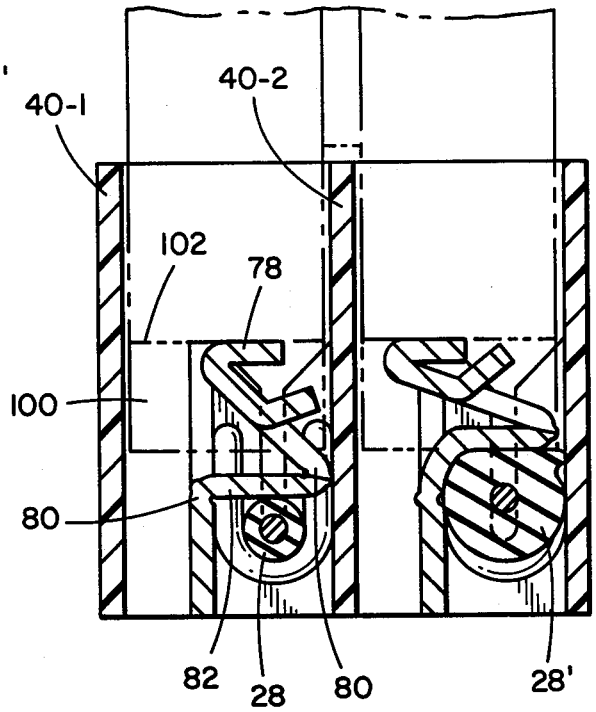
FIG. 4, similar to FIG. 3, shows the wires electrically terminated with strain relief bars of the wire retaining arms overlying the wires.

Wire-receiving portion 46 further includes a resilient retaining arm 74 best shown in FIGS. 3 and 4. Retaining arm 74 extends from a connected end 76 disposed adjacent a first barrier wall 40-1 above the entrances of the wire-receiving slots to a free end 78 spaced from a second barrier wall 40-2 a distance less than the diameter of the wire to be terminated in the wire terminating portion. The retaining arm also has a pair of weakened sections 80 and a strain relief bar 82 disposed between the weakened sections for holding a terminated wire in the slots. Free end 78 of the retaining arm includes an upper finger 84 and a lower finger 86 extending generally parallel and spaced apart less than the wire diameter and extending downwardly toward the second barrier wall 40-2 and the wire receiving slots for holding the wire therebetween and in engagement with the second barrier wall. The upper finger 84 has a cam surface 88 for directing the wire toward the second barrier wall so that the wire upon being moved laterally of its axis between the free end and the second barrier wall deflects the retaining arm toward the first barrier wall. Upon cessation of its lateral movement, the wire is compressively held between the free end and the second barrier wall. Free end 78 and second barrier wall 40-2 comprise means for mechanically holding the wire to be terminated in alignment with the entrance of the wire-receiving slot prior to electrical termination of the wire.

Those skilled in the art will appreciate that the feature of the connector itself firmly mechanically holding the wires in position to be terminated makes the fabrication of the wire harness much simpler and faster because fanning strips or wire positioning jigs are no longer required on the layout or panel board, as the connector itself performs their function. Furthermore, this feature of the connector permits wire harnesses to be assembled, except for electrical termination of the wires in the slots, at a plurality of layout stations. As the partially completed harnesses can be moved without the various wires becoming dissociated from their corresponding wire-receiving slots, the harnesses can be removed from their layout stations and taken to a common termination station where the wires are terminated by a single set of wire termination apparatus. It also allows a workman highly skilled in layout to work exclusively in layout at a first station and, conversely, a workman highly skilled in termination can work exclusively at termination at a second station.

Referring to FIG. 2, front wall 36 and back wall 38 each have a series of upstanding fingers 90 and 92, respectively, with adjacent fingers in each series defining corresponding pairs of openings 94 and 96 in the front and back wall, respectively. A pair of openings adjoin each cavity for receiving a wire moved laterally of its axial direction into the cavity. The pair of openings is in general alignment with the wire receiving slots of the terminal element disposed in the cavity.

Operation of the connector 32 is as follows: After the connector is positioned as by forcing the connector downwardly over dummy terminal pins or dowels extending from a wiring layout board with the dowels being received and held by pin receiving portions 48 of the terminal elements 44, one or more wires are run over the connector adjacent their corresponding terminal elements 44. The individual wires are moved laterally of their axes into aligned housing openings 94 and 96 and against cam surface 88 of retaining arm 74. With reference to FIG. 3, continued downwardly movement of the wire against cam surface 88 causes the retaining arm to be deflected toward first barrier wall 40-1 and force applied to the wire due to the resiliency of the arm pushes the wire against second barrier wall 40-2. In the case of a wire 28 having normal insulation wall thickness shown disposed in the left cavity of FIG. 3 the wire is firmly mechanically held between upper and lower free end fingers 84 and 86 against the second barrier wall. The larger wire 28' shown in the right cavity of FIG. 3 is firmly held between only upper finger 84 and the barrier wall. It is noted that due to the greater diameter of the wire 28' greater force is required for the wire to move between finger 84 and the second barrier wall, and since the retaining arm undergoes greater deflection it applies greater force against the larger wire.

FIG. 3 shows the wire firmly mechanically held by components of the connector in alignment with the entrance 58 of the slots 54 in which the wire is to be terminated. Shown in phantom at the top of FIG. 3 are die units 98 of a ram (not shown) for inserting the wires in their corresponding pairs of wire-receiving slots. Thereafter the die unit deforms the retaining arm so that strain relief bar 82 overlies and preferably engages the corresponding terminated wire. More specifically, each die unit 98 includes spaced wire insertion die members 100 for engaging the wire adjacent one of the slotted plates and a retaining arm die member 102 for deforming the retaining arm after the wire has been electrically terminated. The die unit can be part of termination apparatus of varying degrees of complexity and manually, pneumatically, hydraulically or electrically driven.

Referring to FIG. 4, as the die unit advances downwardly the wire insertion die members force the wire, guided by the slot entrances 58, into the slots 54 stripping the insulation from the wire to electrically terminate it. With the wire in the slots, the retaining arm die member 102 engages the retaining arm 74 which, due the presence of weakened sections 80, deforms. More specifically, strain relief bar 82 rotates clockwise with respect to connected end 76 while free end 78 rotates counter-clockwise relative to bar 82 so that in its deformed position the bar overlies and engages the wire. The strain relief bar is preferably slightly longer than the distance from lower weakened zone 80 to second barrier wall 40-2 and the lower weakened zone 80 is preferably disposed above the bottom of wire receiving slot 54 a distance slightly less than the diameter of the wire 28 so that, as shown in the left cavity of FIG. 4, in its deformed position the strain relief bar extends generally horizontally over the wire 28 and engages the second barrier wall 40-2 to provide increased resistance to wire pullout.

As a method of fabricating a wire harness, the present invention comprises the following steps:

(a) Connectors 32 are positioned at predetermined positions at a first station.

(b) Wires 28 are run in lengths dictated by the dimensions of the completed wire harness between predetermined terminal element locations at the connectors.

(c) The various wires are fixed in the respective holding means associated with the terminal element locations.

(d) The various wires are terminated by inserting them into their corresponding wire-receiving slots.

An optional step permitted by the presence of the holding means of connector 32, to be performed after step (c) above is:

(e) The completed except for electrical termination (incipient) harness is moved to a termination station remote from the first or layout station.

Figure 5:
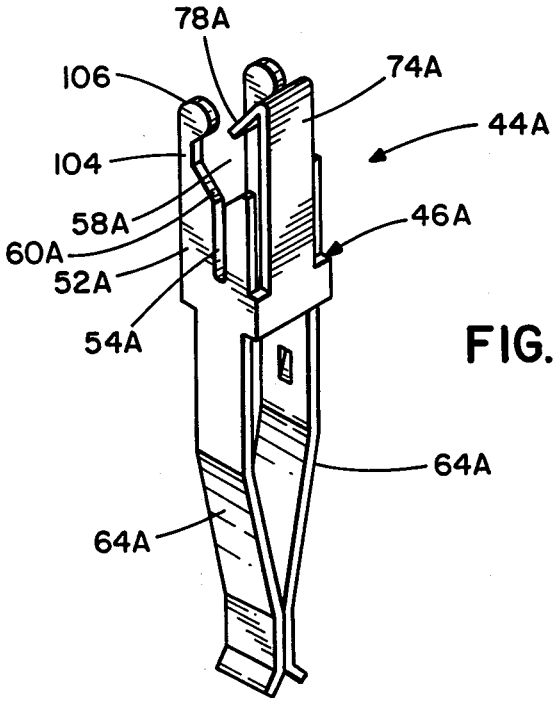
FIG. 5 is a perspective view of an alternate embodiment of the terminal element of the present invention.
Figure 6:
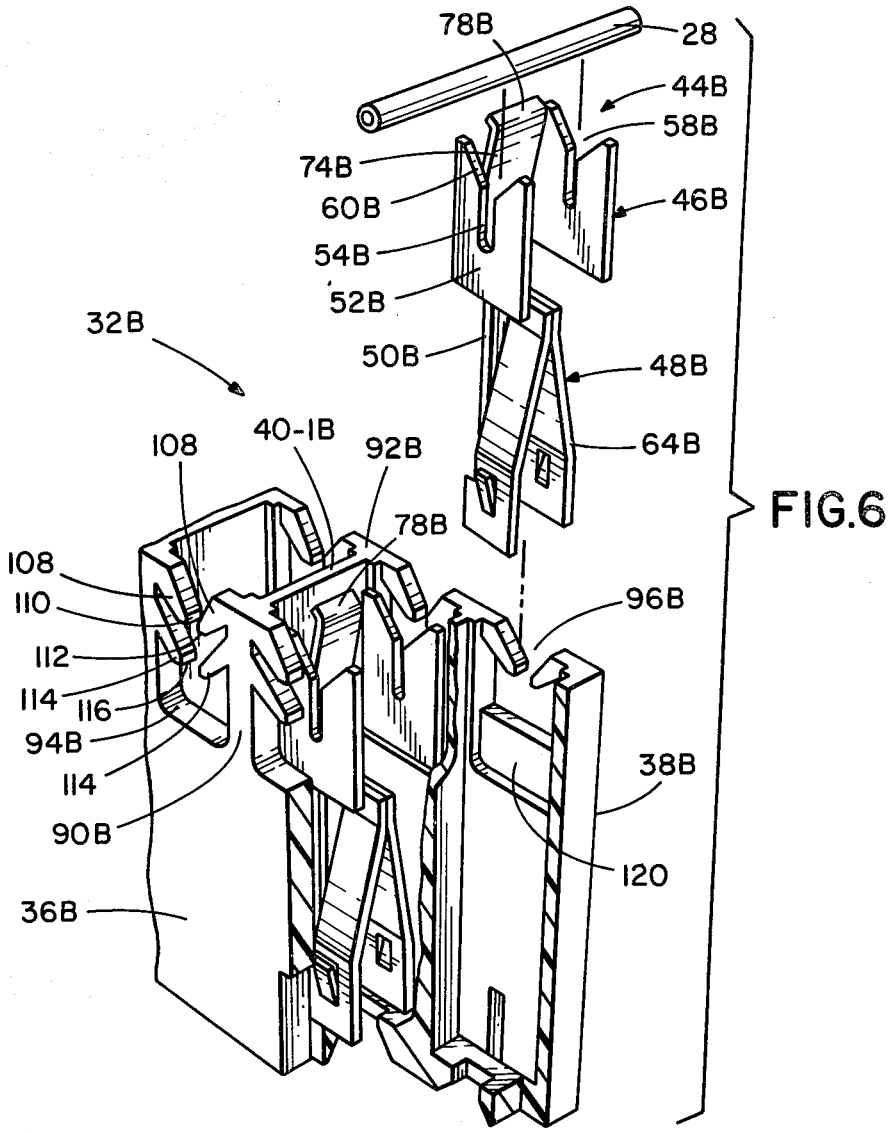
FIG. 6 is an exploded perspective view of an alternate embodiment of the connector of the present invention having a housing including holding ears and strain relief ears, and a terminal element having a strain relief arm, with certain components of the housing removed.
Figure 7:
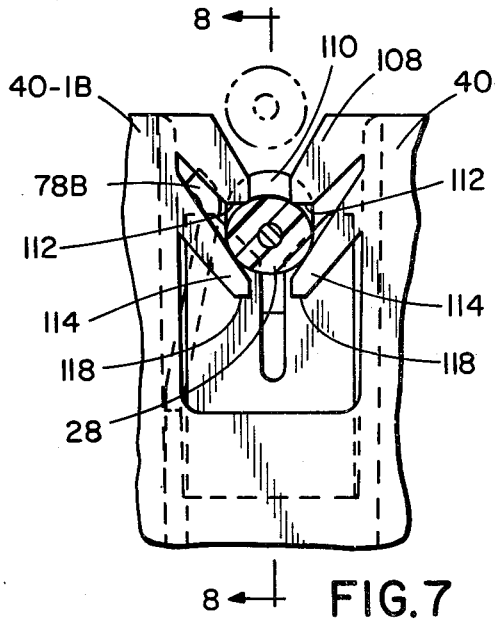
FIG. 7 is a partial front elevational view of the embodiment of FIG. 6 showing the housing holding ears mechanically holding the wire prior to its electrical termination.
Figure 8:
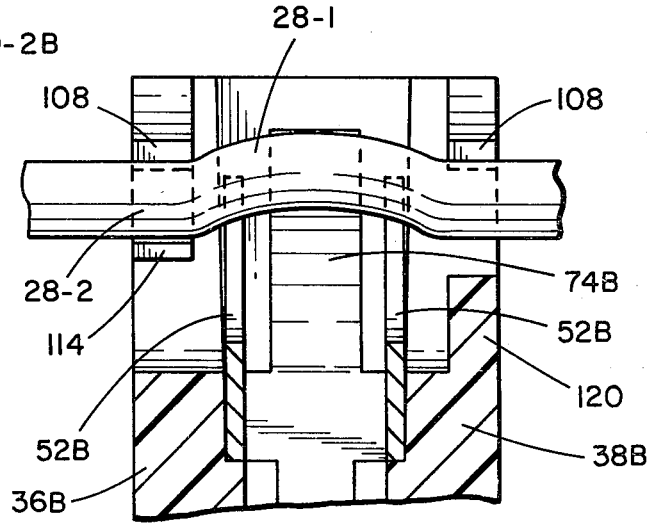
FIG. 8 is a partial sectional view, taken generally along line 8—8 of FIG. 7.
Figure 9:
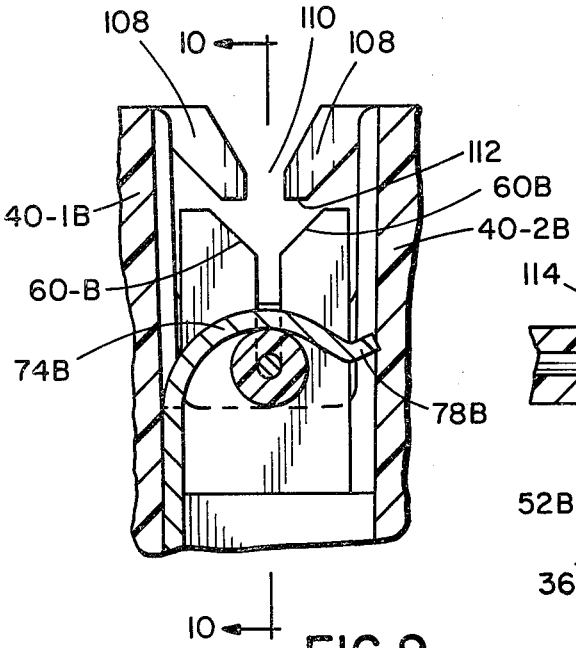
FIG. 9 is a partial sectional view of the embodiment of FIG. 6 showing the wire electrically terminated and with the terminal element strain relief arm overlying the wire.

Referring to FIG. 5, an alternate embodiment of the terminal element of the present invention is shown at 44A. Components of terminal element 44A similar to previously described components of terminal element 44 are designated by the suffix "A". In the alternate embodiment pin receiving spring arms 64A extend directly from wire receiving portion 46A and converge remote from the wire receiving portion. Extending upwardly from each slotted plate 52A and opposite retaining arm 74A is a leg 104 terminating in an enlarged foot 106. The spacing between feet 106 and the free end 78A of the retaining arm is such that a wire 28 moved laterally of its axis therebetween is firmly mechanically held in alignment with respective entrances 58A of corresponding wire-receiving slots 54A prior to its electrical termination in the slots. Accordingly, feet 106 and free end 78A constitute the holding means of a connector 32A of the present invention utilizing terminal element 44A. Operation of terminal element 44A is similar to that of terminal element 44 heretofore described.

Figure 10:
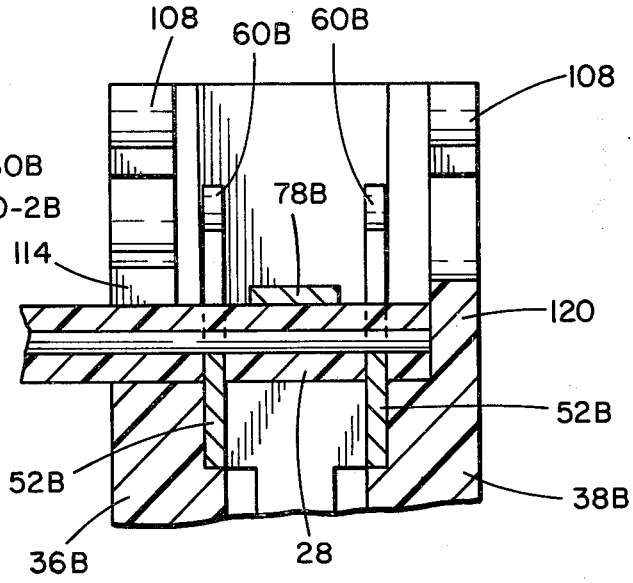
FIG. 10 is a partial sectional view taken generally along line 10—10 of FIG. 9.

With reference to FIGS. 6–10, an alternate embodiment of the connector of the present invention is generally indicated by reference character 32B. Components of connector 32B similar to previously described components of connector 32 are designated by the suffix "B". The upstanding fingers 90B and 92B of front wall 36B and back wall 38B, respectively, defining the pair of aligned wire receiving openings 94B and 96B each have an upper ear 108 extending downwardly into its corresponding opening to define an upper constricted throat 110 thereto. Each ear 108 comprises an abutment surface 112 for engaging a wire inserted past the constricted throat to preclude its escape from the opening prior to its electrical termination and constricted throat 110 is of a width less than the diameter of the wire to be inserted. Adjacent fingers 90B forming openings in front wall 36B also each have a lower ear 114 extending downwardly into an opening 94B to define a lower constricted throat 116 having a width less than the diameter of a wire 28. Similarly each lower ear 114 has a lower abutment surface 118 for engaging an electrically terminated wire inserted past the lower constricted throat to provide strain relief therefor. The lower portion of each opening 96B in back wall 38B is traversed by an enclosure 120 for protecting the end of a terminated wire after the excess portion of the wire has been trimmed as shown in FIG. 10.

Terminal element 44B is quite similar to previously described element 44 except retaining arm 74B primarily performs a strain relief function and has a barb-like free end 78B bent to extend upwardly and toward first barrier wall 40-1B. Arm 74B is movable from a first position, shown in FIG. 7, wherein it is disposed adjacent first barrier wall 40-1B so that wire 28 can be inserted into wire receiving slots 54B without interference from the arm to a second position, shown in FIG. 9, wherein arm 74B extends across the slots and above the terminated wire with its free end 78B gouging into second barrier wall 40-2B.

In this embodiment of the present invention, the converging support surfaces 60B, defining entrances 58B to corresponding wire-receiving slots 54B, and the upper housing ears 108 constitute the holding means for firmly mechanically holding wires 28 in alignment with their respective wire-receiving slots prior to their electrical termination. More specifically, and with reference to FIGS. 7 and 8, the abutment surfaces 112 of ears 108 are positioned relative to support surfaces 60B so that a wire portion 28-1 engaged by the support surfaces is disposed above a wire portion 28-2 engaged by the abutment surfaces whereby, due to its resiliency, the wire 28 is concurrently held in compressive engagement adjacent its bottom by support surfaces 60B and adjacent its top by abutment surfaces 112 prior to its termination in wire-receiving slots 54B.

Taking into account the differences in the components of connector 32B, as opposed to connector 32, which provide the holding prior to termination and strain relief functions, operation of connector 32B is similar to that hereinabove described concerning connector 32. It is noted that the retaining arm die member used for connector 32B preferably has an inclined leading surface with, referring to FIG. 7, the lower end of the surface adjacent barrier wall 40-1B. This will insure that, after termination of the wire by the wire insertion die member, the free end 78B of retaining arm 74B is moved toward second barrier wall 40-2B prior to the arm undergoing permanent deformation. A salient advantage of connector 32B is that due to the presence of upper ears 108 disposed on both the front and back walls of the housing, the wire is mechanically held on both sides of the terminal element to prevent a loose end of the wire from interferring with the wire terminating apparatus.

Figure 11:
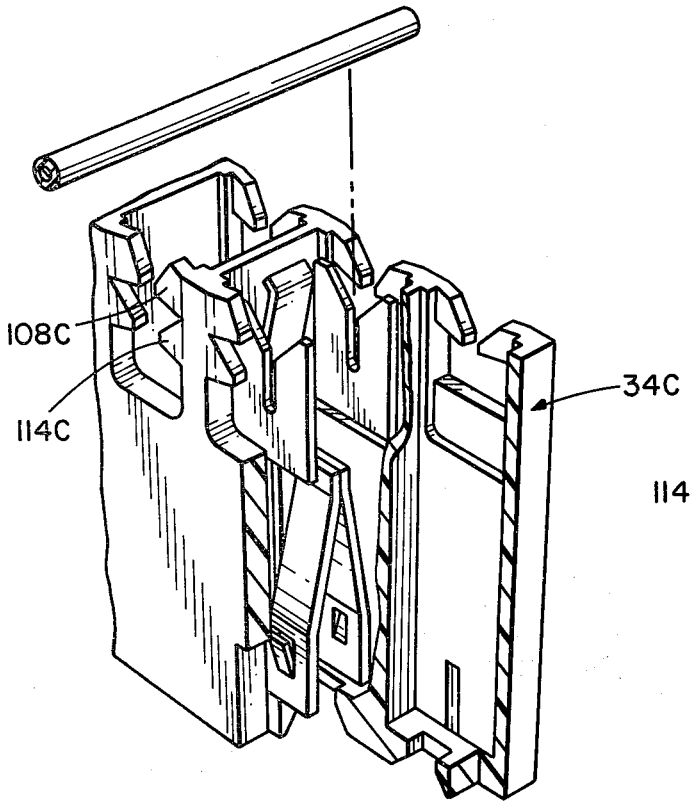
FIG. 11 is a partial perspective of an alternate embodiment of the housing of FIG. 6 with certain components removed.
Figure 12:
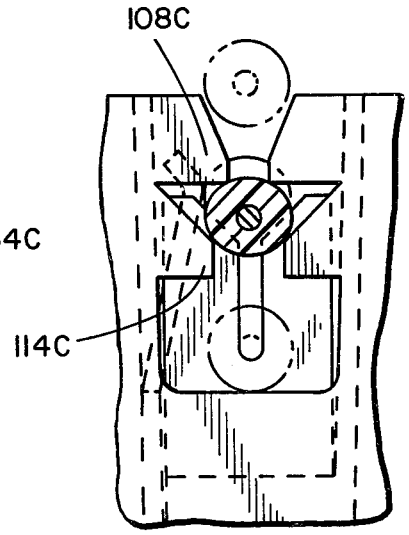
FIG. 12 is a partial front elevational view of the housing of FIG. 11 showing the housing holding ears retaining the wire prior to its electrical termination.
Figure 13:
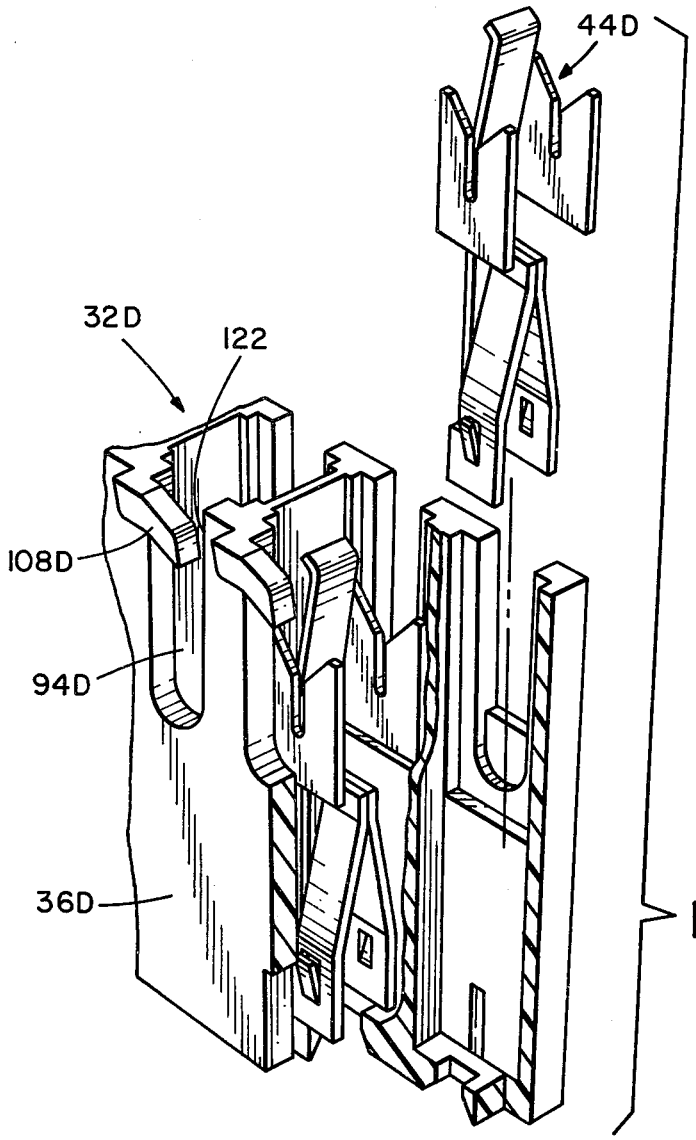
FIG. 13 is a partial exploded perspective of another alternate embodiment of the present invention including a terminal element comprising an arm having a first position for holding the wire prior to its electrical termination and a second position for providing strain relief for the wire after its electrical termination.

Referring to FIGS. 11 and 12, an alternate embodiment of the housing of the connector of the present invention is generally indicated by reference character 34C. Components of housing 34C similar to previously described components of housing 34 or 34B are designated by the suffix "C". The primary difference between housing 34C and housing 34B is that the ears 108C and 114C are stronger and more rigid and therefore undergo little or no deflection during wire insertion and termination. Although wire insertion between pairs of fingers 108C and 114C, respectivley, requires greater force, this configuration offers increased wire holding strength prior to termination and greater strain relief strength after wire termination. The operation of housing 34C is similar to that of housing 34B described above.

Figure 14:
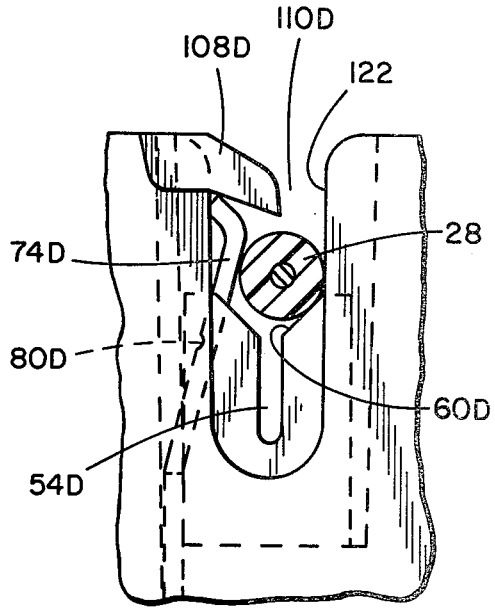
FIG. 14 is a partial front elevational view of the embodiment of FIG. 13 showing the terminal element arm in its first position.
Figure 15:
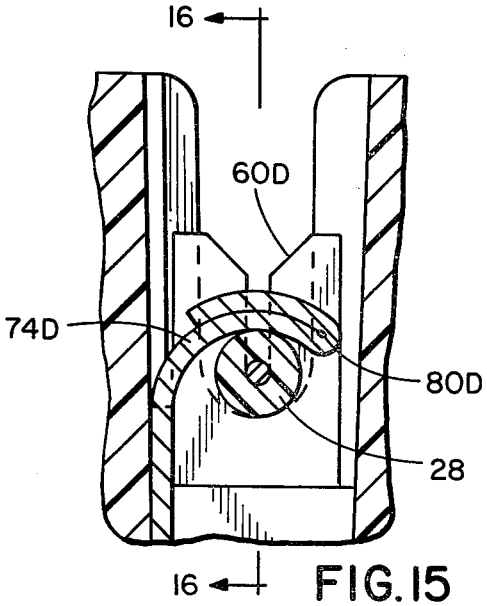
FIG. 15 is a partial sectional view, similar to FIG. 14, showing the terminal element arm in its second position.
Figure 16:
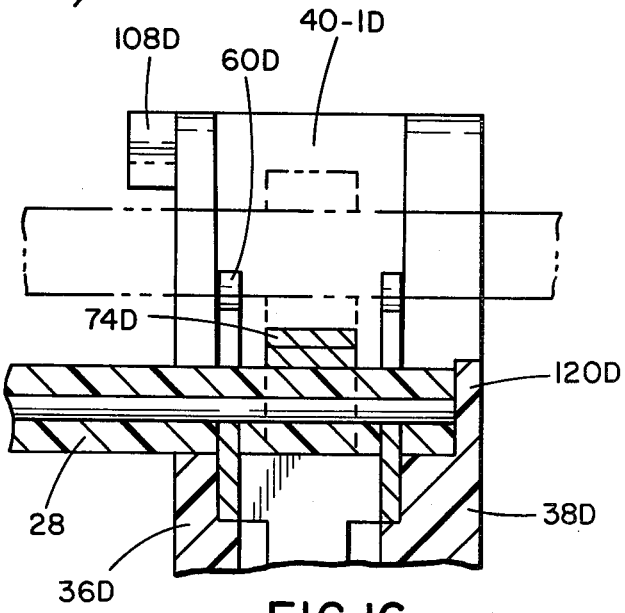
FIG. 16 is a partial sectional view taken generally along line 16—16 of FIG. 15.
Figure 17:
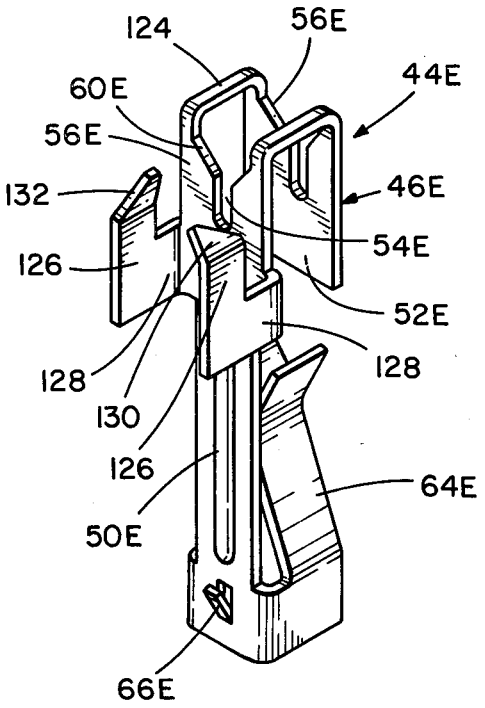
FIG. 17 is a perspective view of another alternate embodiment of the terminal element of the present invention including strain relief arms having a formed position and a strain relief position.

Referring to FIGS. 13–16 an alternate embodiment of the connector of the present invention is generally indicated by reference character 32D with components of connector 32D corresponding to components of previously described connectors designated by the suffix "D". Openings 94D in the front housing wall 36D are narrower than previously shown so that a single ear 108D and a facing surface 122 of the opening 94D define constricted throat 110D. As shown in FIG. 14, wire 28 is mechanically held prior to electrical termination by retaining arm 74D pushing the wire against housing surface 122 and a support surface 60D of the entrance of the wire-receiving slot. It will be appreciated by those skilled in the art that if, due to an unusually great wire withdrawal force, the wire 28 starts to move upwardly, its escape from the housing will be precluded by overlying ear 108D. Accordingly, the means for holding the wire prior to termination comprises retaining arm 74D, terminal element support surface 60D, housing surface 122 and ear 108D. As shown in FIG. 15 retaining arm 74D has a transversely weakened section 80D so that when the arm is deformed to offer strain relief for the terminated wire, it will be folded back on itself to increase its rigidity. Operation of connector 32D is similar to that of connectors 32 and 32B previously described.

An alternate wire terminating portion of a terminal element of the general type used in connectors 32, 32B or 32D comprises a T-shaped retaining or strain relief arm with the leg of the T connected to the remainder of the terminal element and the crossbar of the T extending generally parallel to the common axis of the wire-receiving slots. The T-shaped arm is movable from a first position wherein it is disposed adjacent a first barrier wall so that a wire can be inserted into the wire-receiving slots without interference from the arm to a second or strain relief position wherein the crossbar is disposed in the slots above the terminated wire to prevent the wire from escaping from the slots.

Figure 18:
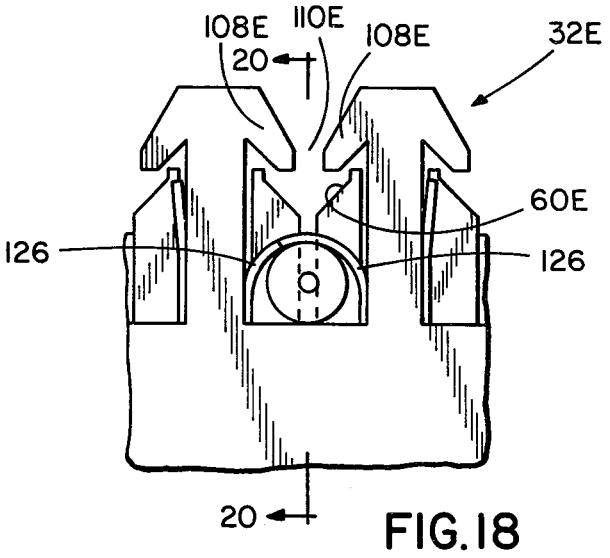
FIG. 18 is a partial front elevational view of another embodiment of the connector of the present invention including a housing having holding arms and using the terminal element of FIG. 17, showing an electrically terminated wire and the terminal element strain relief arms in their strain relief position.
Figure 19:
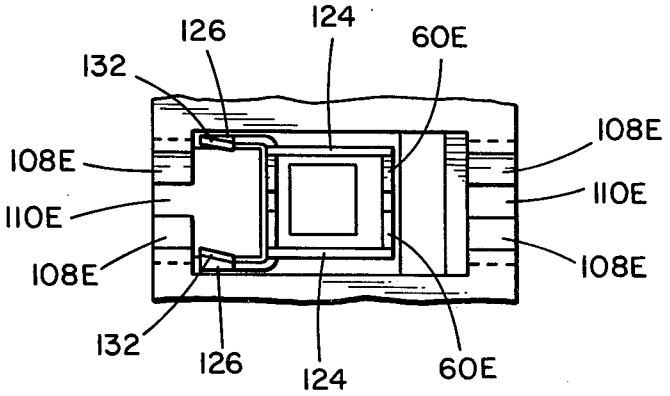
FIG. 19 is a partial plan of the connector of FIG. 18.
Figure 20:
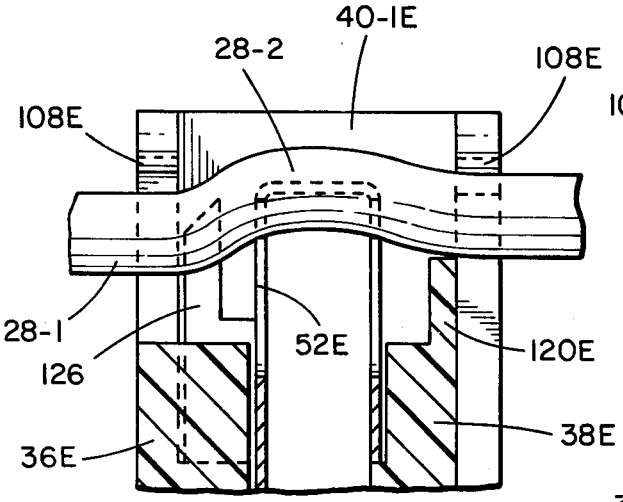
FIG. 20 is a partial cross-sectional view of the connector of FIG. 18 showing the wire mechanically held prior to its electrical termination.
Figure 21:
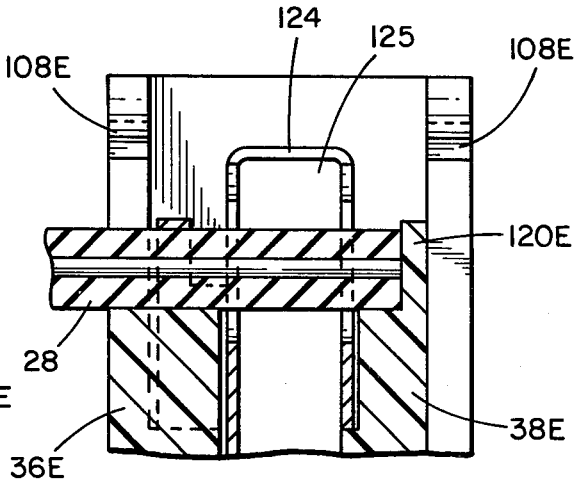
FIG. 21 is a partial cross-sectional view, similar to FIG. 20, showing the wire electrically terminated.
Figure 22:
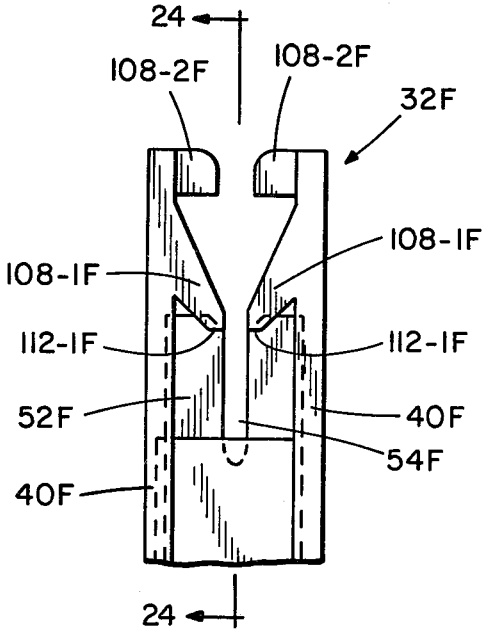
FIG. 22 is a partial front elevation of an alternate embodiment of the connector of the present invention.
Figure 23:
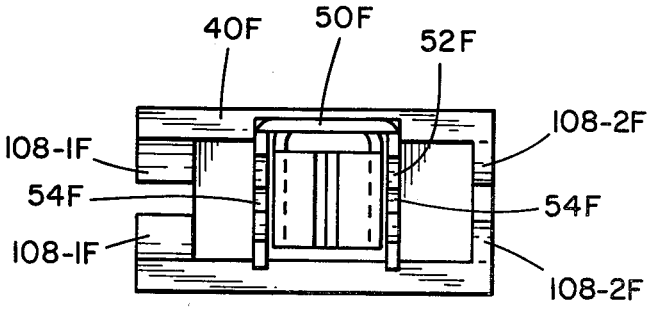
FIG. 23 is a partial plan of the connector of FIG. 22.

Referring now to FIGS. 17–21, an alternate embodiment of the connector of the present invention is generally indicated by reference character 32E with components thereof corresponding to components of previously described connectors designated by the suffix "E". Wire receiving portion 46E of terminal element 44E comprises a pair of spaced links 124 each bridging aligned plate sections 56E of the respective wire-receiving plates 52E. Barrier walls 40E are provided with ledges 125 for supporting links 124. Wire receiving portion 46E further comprises, disposed between front wall 36E and the plate 52E adjacent the front wall, a pair of facing strain relief arms 126 joined to plate 52E by respective cantilevers 128. The distal end 130 of each arm is of generally triangular configuration and has a surface 132 engageable with a like surface of the distal end 130 of the other strain relief arm 126 when the arms are deformed to retain a terminated wire. More specifically, the strain relief arms are movable from first or formed positions wherein one arm is disposed adjacent first barrier wall 40-1E and the other arm is positioned adjacent second barrier wall 40-2E so that a wire can be inserted into the wire receiving slots 54E without interference from the arms to second or deformed positions, as shown in FIG. 18, wherein arms 126 extend over a terminated wire 28 to prevent its escape from wire receiving slots 54E and wherein the distal ends 130 are situated side-by-side and in full surface engagement to present a neat appearance. It will be appreciated that a similar set of strain relief arms could be provided between back wall 38E and the wire receiving plate 52E adjacent thereto.

Operation of connector 32E is similar to that of connector 32B above described in that housing ears 108E and wire receiving slot entrance surfaces 60E constitute means for firmly mechanically holding a wire 28 prior to its electrical termination in slots 54E. The die unit used with connector 32E has a retaining arm die member which moves strain relief arms 126 to their second positions after wire 28 has been received within slots 54E.

Referring now to FIGS. 22–25, another alternate embodiment of the connector of the present invention is generally indicated by reference character 32F with components thereof corresponding to components of previously described connectors designated by the suffix "F". Terminal element 44F is quite similar to terminal element 44 except it does not have a retaining arm.

Figure 24:
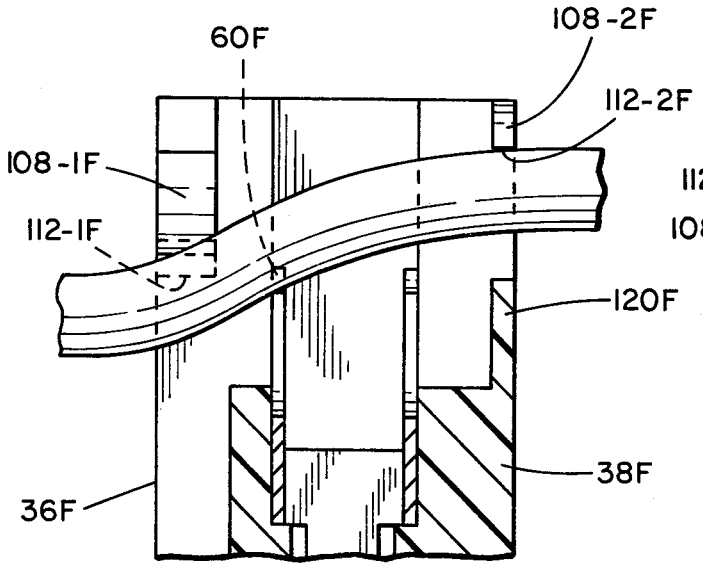
FIG. 24 is a partial cross-sectional view of the connector of FIG. 22 showing a wire mechanically held prior to its electrical termination.
Figure 25:
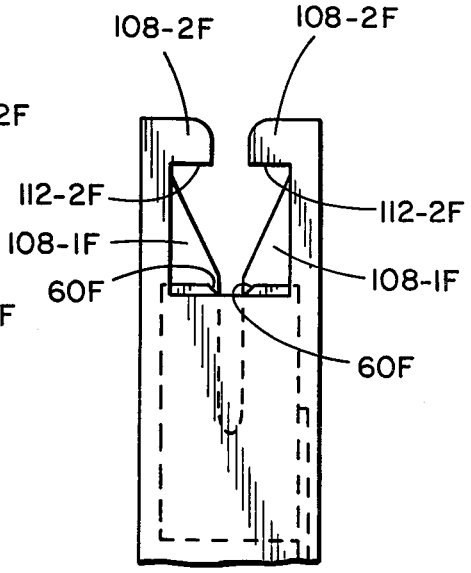
FIG. 25 is a partial back elevation of the connector of FIG. 22.

Front wall ears 108-1F have abutment surfaces 112-1F disposed below the level of the abutment surfaces 112-2F of back wall ears 108-2F. A wire 28 engaging abutment surfaces 112-1F and 112-2F and support surfaces 60F is bowed so that, due to its resiliency and as shown in FIG. 24, it is firmly mechanically held prior to its electrical termination in slots 54F. In this embodiment the holding means comprises abutment surfaces 112-1F and 112-2F along with support surface 60F. A salient advantage of this embodiment is that front wall abutment surfaces 112-1F serve a dual function in that prior to electrical termination they aid in holding the wire and after termination of the wire they function as strain relief members to prevent the wire from escaping from slots 54F.

Operation of connector 32F is similar to that of other connectors of the present invention described above.

It should be noted that the barrier walls could be provided with protuberances having surfaces which provide the function of support surfaces 60F and in that case the holding means would be constituted exclusively by components of the housing.

Although connectors of the present invention have been described for use in terminating a plurality of discrete wires 28, it will be appreciated that the design of the connectors is conducive for use with flat cables of the type wherein an array of parallel, regularly spaced, coplanar conductors are sandwiched between an upper and lower sheet of insulation with insulation between adjacent conductors forming webs. With a transverse row of openings formed in the webs and matching the placement of barrier walls of the connector, the flat cable can be moved laterally of the axes of the conductors with each conductor being received by a corresponding housing cavity 42. With the various conductors held by their associated holding means, the partially completed harness can be moved to a mass wire termination station where the conductors can be terminated.

In view of the above, it will be seen that the several objects of the invention are achieved and other advantageous results attained.

As various changes could be made in the above constructions without departing from the scope of the invention, it is intended that all matter contained in the above description shall be interpreted as illustrative and not in a limiting sense.

What is claimed is:

1. An electrical connector for mechanically joining a plurality of wires to a plurality of other electrical components and for providing low resistance electrical paths between predetermined ones of said plurality of wires and preselected ones of said plurality of other electrical components, said connector comprising:

an insulative housing having a front wall, a back wall and a plurality of spaced barrier walls extending between the aforementioned walls to define an array of cavities extending through said housing; and a plurality of metallic terminal elements each having a wire terminating portion and a portion for contacting another electrical component with one terminal element preloaded into each of said cavities, said wire terminating portion having an open-ended elongate wire-receiving slot of a width less than the diameter of the conductor in the wire to be terminated in the wire terminating portion so that in response to the insertion of the wire laterally of its axis into the slot the insulation of the wire is removed, said wire terminating portion further having an entrance adjoining said slot of greater width than said slot to guide the wire into the slot, at least one of said housing and plurality of terminal elements comprising holding means for firmly mechanically holding each of said wires in alignment with the entrance to the slot corresponding to that wire prior to insertion of the wire into the slot, said holding means being adapted to hold said wires bent from their as-manufactured axial direction and comprising first means for engaging said wires on the side of said terminal elements remote from said back wall, further comprising second means for engaging said wires on the side of said terminal elements remote from said front wall, and further comprising third means for engaging said wire between said first and second wire engaging means, whereby after positioning of the wires in the holding means and prior to insertion of the wires into the slots, the connector can be physically moved without dissociation of the wires from their corresponding slots.

2. A connector as set forth in claim 1 wherein at least one of said barrier walls and said back wall define a series of openings on the side of said terminal elements remote from said front wall with each of said openings adjoining one of said cavities for receiving a wire moved laterally of its axial direction into the cavity, said second means for engaging said wires comprising at least one ear extending into each of said series of openings to define a constricted throat for each opening, said housing comprising a series of enclosures each of which is adjacent one of said openings for protecting and insulating an end of one of said wires after the wire has been trimmed substantially flush with said enclosure and the wire has been terminated in the wire terminating portion of a terminal element.

3. An electrical connector as set forth in claim 1 wherein said wire terminating portion of said terminal element comprises a pair of spaced generally parallel plates extending generally perpendicularly to first and second barrier walls defining the cavity for receiving said terminal element, each plate having said wire-receiving slot with the slots in each plate having a common axis.

4. An electrical connector as set forth in claim 3 wherein said wire terminating portion further comprises a strain relief arm for engaging a wire terminated in the wire-receiving slots, said arm having a connected end and a distal end, said arm being movable from a first position wherein it is disposed adjacent said first barrier wall so that a wire can be inserted into said slots without interference from said arm to a second position wherein the arm extends over the terminated wire.

5. An electrical connector as set forth in claim 3 wherein said wire terminating portion further comprises a T-shaped strain relief arm, the leg of the T connected to the remainder of the terminal element and the crossbar of the T extending generally parallel to the axis of the slots, said arm being movable from a first position, wherein it is disposed adjacent said first barrier wall so that a wire can be inserted into said slots without interference from said arm to a second position wherein said crossbar is disposed in said slots above the terminated wire to prevent the wire from escaping from said slots.

6. An electrical connector as set forth in claim 3 wherein said wire terminating portion further comprises a pair of opposed strain relief arms each having a connected end and a free end, said arms being movable from first positions wherein one arm is disposed adjacent said first barrier wall and the other arm is positioned adjacent the second barrier wall so that a wire can be inserted into said slots without interference from said arms to second positions wherein said arms extend over the wire inserted in said slots to prevent its escape and wherein the free ends of said arms are situated side-by-side and in full surface engagement.

7. A connector as set forth in claim 3 wherein each plate includes an entrance adjoining the wire-receiving slot of that plate, each entrance being of greater width than the adjoining slot, said third means for engaging said wire comprising the entrance to each slot.

8. A connector as set forth in claim 1 wherein at least one of said barrier walls and said front wall defines a series of first openings on the side of said terminal elements remote from said back wall and further wherein at least one of said barrier walls and said back wall defines a series of second openings on the side of said terminal elements remote from said front wall, ones of said first openings and ones of said second openings forming pairs of openings with each pair of openings adjoining one of said cavities for receiving a wire moved laterally of its axial direction into the cavity, each pair of openings being in general alignment with the wire-receiving slot of the terminal element disposed in the cavity adjoining a particular pair of openings, said housing comprising at least one first ear extending into each of said series of first openings to define a constricted throat for each first opening, said constricted throat having a width less than the diameter of the wire to be received whereby a wire moved into the opening beneath the level of the ear is retained in the opening, said first means for engaging said wires comprising said first ears.

9. A connector as set forth in claim 8 or claim 11 wherein said housing comprises at least one second ear extending into each of said series of second openings to define a constricted throat for each second opening, said second means for engaging said wires comprising said second ears.

10. A connector as set forth in claim 9 wherein said housing comprises a pair of first ears defining said constricted throat for each first opening and a pair of second ears defining said constricted throat for each second opening.

11. A connector as set forth in claim 8 wherein said wire terminating portion comprises a support surface defining said entrance to said slot for supporting said wire prior to its insertion into said slot, said first opening ear comprising an abutment surface for engaging a wire inserted in a first opening past said constricted throat, said abutment surface being positioned relative to said support surface so that a wire portion engaged by said support surface is disposed above a wire portion engaged by said abutment surface, said holding means comprising said support surface and said abutment surface whereby due to the resiliency of the wire, the wire is concurrently held in compressive engagement adjacent its bottom by said support surface and adjacent its top by said abutment surface prior to electrical termination of the wire in the wire-receiving slot, said third engaging means comprising said support surface.

12. A connector as set forth in claim 11 wherein said housing comprises at least one second ear extending into each of said series of second openings to define a constricted throat for each second opening, said abutment surface of said first ear being a first abutment surface and said second ear having a second abutment surface for engaging a wire disposed in said second opening, said second abutment surface being disposed above the level of said first abutment surface, whereby a wire engaging said first and second abutment surfaces and said support surface is bowed, said first abutment surface being engageable with said wire after it has been terminated in said slot to provide strain relief.

13. A connector as set forth in claim 11 wherein said housing comprises at least one second ear extending into each of said series of second openings to define a constricted throat for each second opening, said abutment surface of said first ear being a first abutment surface and said second ear having a second abutment surface for engaging a wire disposed in said second opening, said first and second abutment surfaces being disposed at substantially the same level relative to the position of said support surface, whereby a wire engaging said first and second abutment surfaces and said support surface is bowed, said first and second abutment surfaces being engageable with said wire after it has been terminated in said slot to provide strain relief.

14. A connector as set forth in claim 11 wherein said housing comprises at least one second ear extending into each of said series of second openings to define a constricted throat for each second opening, said abutment surface of said first ear being a first abutment surface and said second ear having a second abutment surface for engaging a wire disposed in said second opening, at least one of said first abutment surface and said second abutment surface being engageable with said wire after it has been terminated in said slot to provide strain relief.

15. An electrical connector for mechanically joining a plurality of wires to a plurality of other electrical components and for providing low resistance electrical paths between predetermined ones of said plurality of wires and preselected ones of said plurality of other electrical components, said connector comprising:

an insulative housing having a front wall, a back wall and a plurality of spaced barrier walls extending between the aforementioned walls to define an array of cavities extending through said housing; and a plurality of metallic terminal elements each having a wire terminating portion and a portion for contacting another electrical component with one terminal element preloaded into each of said cavities, said wire terminating portion having an open-ended elongate wire-receiving slot of a width less than the diameter of the conductor in the wire to be terminated in the wire terminating portion so that in response to the insertion of the wire laterally of its axis into the slot the insulation of the wire is removed, said wire terminating portion further having an entrance adjoining said slot of greater width than said slot to guide the wire into the slot, at least one of said housing and plurality of terminal elements comprising holding means for firmly mechanically holding each of said wires in alignment with the entrance to the slot corresponding to that wire prior to insertion of the wire into the slot, whereby after positioning of the wires in the holding means and prior to insertion of the wires into the slots, the connector can be physically moved without dissociation of the wires from their corresponding slots;

said wire terminating portion comprising a pair of spaced generally parallel plates extending in a direction generally perpendicular to said barrier walls and each having said wire-receiving slot and an entrance to the slot aligned, respectively, with the slot and entrance in the other plate, said wire terminating portion further comprising a resilient retaining arm extending from a connected end disposed adjacent a first barrier wall, above the entrances of said slots and to a free end spaced from a second barrier wall a distance less than the diameter of the wire to be terminated in said wire terminating portion, said first and second barrier walls defining one of said cavities, said retaining arm and said second barrier wall constituting said holding means.

16. A connector as set forth in claim 15 wherein said free end of the retaining arm includes a cam surface for directing a wire to be inserted between said free end and said second barrier wall toward said second barrier wall whereby the wire upon being moved laterally of its axis between said free end and said second barrier wall deflects said retaining arm toward said first barrier wall and, upon cessation of its lateral movement, the wire is compressively held between the free end and the second barrier wall.

17. A connector as set forth in claim 16 wherein said free end of the retaining arm comprises a pair of generally parallel fingers spaced apart less than the wire diameter and extending downwardly toward said second barrier wall and said wire receiving slots for holding the wire therebetween and in engagement with said second barrier wall, one of said fingers comprising said cam surface.

18. A connector as set forth in claim 15 wherein said retaining arm comprises a pair of transverse weakened sections and a strain relief bar, extending between said sections, for abutting and maintaining a terminated wire in its wire-receiving slots, said retaining arm being permanently deformable at said weakened sections, said retaining arm being movable from a formed position wherein said bar is disposed between said slots and said first barrier wall to a deformed position wherein said bar extends across said slots toward said second barrier wall and over the electrically terminated wire.

19. A connector as set forth in claim 18 wherein the length of said strain relief bar is sufficient for it to frictionally engage said second barrier wall in the deformed position of said retaining arm.

20. An electrical connector for mechanically joining a plurality of wires to a plurality of other electrical components and for providing low resistance electrical paths between predetermined ones of said plurality of wires and preselected ones of said plurality of other electrical components, said connector comprising:

an insulative housing having a front wall, a back wall and a plurality of spaced barrier walls extending between the aforementioned walls to define an array of cavities extending through said housing; and a plurality of metallic terminal elements each having a wire terminating portion and a portion for contacting another electrical component with one terminal element preloaded into each of said cavities, said wire terminating portion having an open-ended elongate wire-receiving slot of a width less than the diameter of the conductor in the wire to be terminated in the wire terminating portion so that in response to the insertion of the wire laterally of its axis into the slot the insulation of the wire is removed, said wire terminating portion further having an entrance adjoining said slot of greater width than said slot to guide the wire into the slot, at least one of said housing and plurality of terminal elements comprising holding means for firmly mechanically holding each of said wires in alignment with the entrance to the slot corresponding to that wire prior to insertion of the wire into the slot, whereby after positioning of the wires in the holding means and prior to insertion of the wires into the slots, the connector can be physically moved without dissociation of the wires from their corresponding slots, said wire terminating portion of said terminal element comprising a pair of spaced generally parallel plates extending generally perpendicularly to first and second barrier walls defining the cavity for receiving said terminal element, each plate having said wire-receiving slot with the slots in each plate having a common axis, said wire terminating portion further comprising a strain relief arm for engaging a wire terminated in the wire-receiving slots, said arm having a connected end and a distal end, said arm being movable from a first position wherein it is disposed adjacent said first barrier wall so that a wire can be inserted into said slots without interference from said arm to a second position wherein the arm extends over the terminated wire, said distal end of said strain relief arm having a barb adapted to gouge said second barrier wall when said arm is in its second position.

21. A terminal element for use in a multi-contact electrical connector for providing low resistance electrical paths between predetermined ones of a plurality of wires and preselected ones of a plurality of other electrical components, said connector having an insulative housing comprising a front wall, a back wall and a plurality of spaced barrier walls extending between the aforementioned walls to define an array of cavities extending through the housing with a terminal element preloaded into each cavity, said terminal element comprising:

a portion for contacting another electrical component; and a wire terminating portion comprising a pair of spaced generally parallel plates extending in a direction generally parallel to said front and back walls, each plate having an open-ended elongate wire-receiving slot of a width less than the diameter of the conductor in the wire to be terminated in the wire terminating portion so that in response to the insertion of the wire laterally of its axis into the slot the insulation of the wire is removed, the slots in each plate being generally aligned, said wire terminating portion further comprising a strain relief arm disposed between the plate closer the front wall and the front wall, said arm having a first or formed position wherein said wire can be inserted into the slots without interference from the arm and a second or strain relief position wherein said arm overlies a terminated wire to preclude its escape from said slots.

22. An electrical connector for mechanically joining a plurality of wires to a plurality of other electrical components and for providing low resistance electrical paths between predetermined ones of said plurality of wires and preselected ones of said plurality of other electrical components, said connector comprising:

an insulative housing having a front wall, a back wall and a plurality of spaced barrier walls extending between the aforementioned walls to define an array of cavities extending through said housing; and a plurality of metallic terminal elements each having a wire terminating portion and a portion for contacting another electrical component with one terminal element preloaded into each of said cavities, said wire terminating portion having an open-ended elongate wire-receiving slot of a width less than the diameter of the conductor in the wire to be terminated in the wire terminating portion so that in response to the insertion of the wire laterally of its axis into the slot the insulation of the wire is removed, said wire terminating portion further having an entrance adjoining said slot of greater width than said slot to guide the wire into the slot, said housing comprising holding means for firmly mechanically holding each of said wires in alignment with the entrance to the slot corresponding to that wire prior to insertion of the wire into the slot, at least one of said barrier walls and said front wall defining a series of first openings on the side of said terminal elements remote from said back wall with each of said openings adjoining one of said cavities for receiving a wire moved laterally of its axial direction into the cavity, said housing comprising at least one upper ear extending into each of said first openings to define an upper constricted throat for each first opening, said housing further comprising at least one lower ear extending into each of said first openings to define a lower constricted throat for each first opening, the spacing between corresponding upper and lower ears being insufficient for a wire to completely pass said upper ear without engaging said lower ear, a wire concurrently engaging an upper ear and a corresponding lower ear being firmly compressively held therebetween, the aforementioned constricted throats having a width less than the diameter of the wire to be received, said holding means comprising said upper and lower ears, whereby after positioning of the wires in the holding means and prior to insertion of the wires in the slots, the connector can be physically moved without dissociation of the wires from their corresponding slots.

23. A connector as set forth in claim 22 wherein at least one of said barrier walls and said back wall define a series of second openings on the side of said terminal elements remote from said front wall, ones of said first openings and ones of said second openings forming pairs of openings with each pair of openings adjoining one of said cavities for receiving a wire moved laterally of its axial direction into the cavity, each pair of openings being in general alignment with the wire-receiving slot of the terminal element disposed in the cavity adjoining that pair of openings, said housing comprising at least one third ear extending into each of said second openings defining a second opening constricted throat having a width less than the diameter of the wire to be received, said holding means further comprising said third ear.

24. A connector as set forth in claim 22 wherein said lower ear comprises an abutment surface engageable with said wire after it has been terminated in said slot to provide strain relief.

* * * * *